United States Patent [19]

Christensson

[11] 4,184,608

[45] Jan. 22, 1980

[54] LINED CONTAINER, ESPECIALLY FOR COMPRESSED AND/OR EVACUATED GOODS

[76] Inventor: Od W. Christensson, Veddestavagen 7-9, S-175 62, Jarfalla, Sweden

[21] Appl. No.: 871,497

[22] Filed: Jan. 23, 1978

[30] Foreign Application Priority Data

Jan. 26, 1977 [SE] Sweden ..... 7700806
Mar. 15, 1977 [SE] Sweden ..... 7702899

[51] Int. Cl.[2] ..... B65D 25/14

[52] U.S. Cl. ..... 220/404; 220/410; 220/462

[58] Field of Search ..... 220/440, 444, 448, 418, 220/402–404, 408, 410, 430, 460–462, 465, 441

[56] References Cited

U.S. PATENT DOCUMENTS

| | | | |
|---|---|---|---|
| 3,206,094 | 9/1965 | Humphrey et al. | 220/462 X |
| 3,392,901 | 7/1968 | Krzyzanowski | 220/462 |
| 3,394,388 | 7/1968 | Kuchlin | 220/461 X |
| 3,416,717 | 12/1968 | Beck, Jr. et al. | 220/462 |
| 3,800,994 | 4/1974 | Bowen et al. | 220/461 X |
| 3,887,125 | 6/1975 | Trentesaux | 220/460 X |

*Primary Examiner*—Joseph Man-Fu Moy
*Attorney, Agent, or Firm*—Larson, Taylor and Hinds

[57] ABSTRACT

A container of the type having a stiff outer container and a formable liner. The liner has a closed end which is exposed at one end of the outer container, the opposite end of the liner being constructed to be filled with product. At the one end of the liner it is pressed down into itself in the central portion thereof to form an upstanding double layer rib all around its periphery. Flaps at the end of the outer container are folded in against the inward facing surface of the liner rib to secure the liner in place and form the central part of the liner at that end as an even openable end of the container.

10 Claims, 9 Drawing Figures

FIG.9a
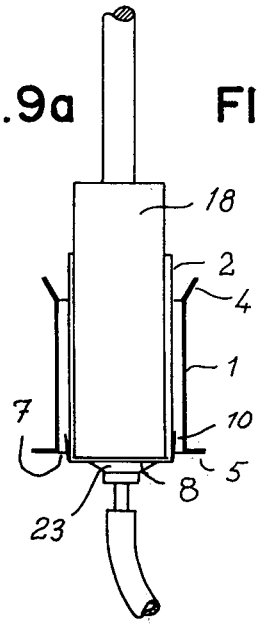
FIG.9b
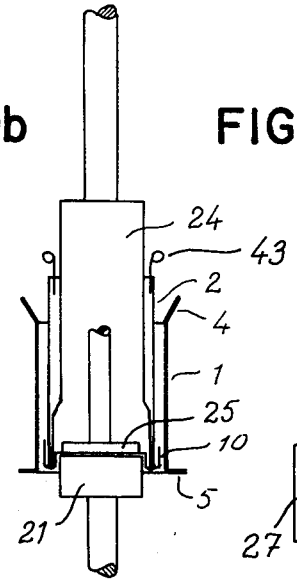
FIG. 9c
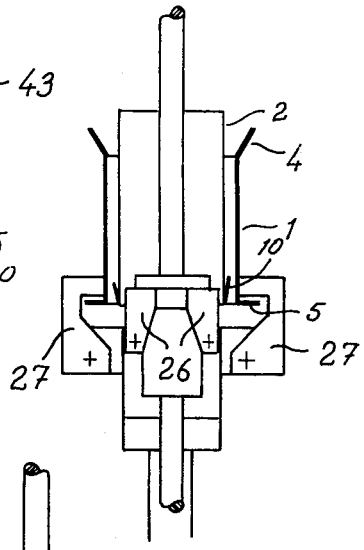
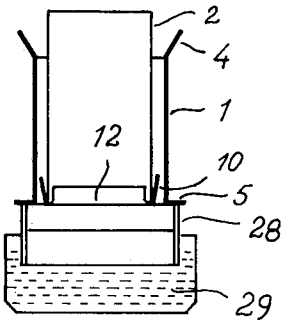
FIG. 9d
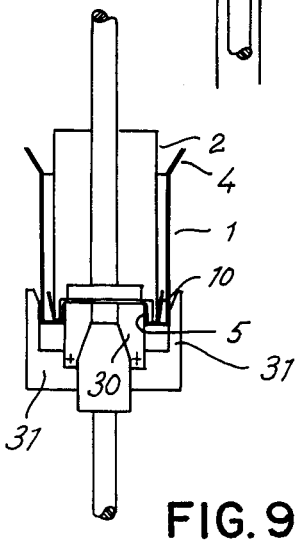
FIG. 9e

LINED CONTAINER, ESPECIALLY FOR COMPRESSED AND/OR EVACUATED GOODS

The present invention relates to a container comprising an outer container of cardboard or similar stiff material and a lining of plastic or other easily formable and preferably gas-sealing material which lining is provided in the said outer container and which at the side of the container to be opened exposes an even single layer of lining material, and which is filled from and closed at the opposite end thereof.

The container according to the invention can be used for packing of any types of goods, but it is in particular suited for packing of compressed and/or evacuated goods of the type which is to be packed hermetically sealed. It is however to be understood that the container can as well be used for packing of any other solid or liquid product.

Containers are previously known, which at the side thereof to be opened expose an even surface of lining material without joints, welds and other means which can make the opening of the container lining difficult. The opening generally takes place in that the lining is cut open by a knife or it is opened by a special tear tongue or similar means.

The said previously known containers are formed so that the lining with the side thereof to be opened extend substantially on plane with the upper edge of the outer container. The containers are filled from bottom and are sealed at the bottom, and since the packed goods can usually not be made to completely fill the volume of the outer container some empty space is obtained at the bottom of the container. If the containers are handled carelessly or if they are subjected to shaking or vibrating during transport or similar actions it may happen that the lining becomes unstuck from the outer container which may both give the container a less attractive appearance and make the opening of the container difficult.

When the container is opened in that the opening side of the lining is cut or torn open it may happen that some portion of the packed goods penetrates from the lining and tends to drop out aside of the container. Also the packed goods may tend to penetrate into the space between the lining and the outer container, which in turn further increases the risk that the lining will become unstuck from the outer container. Especially with such types of containers which are used as distribution containers for instance for coffee, flour, grain and similar products there is a great risk of spilling some product when picking some portion of the packed goods up since the packed goods is located at a height in the container substantially at the level of the upper edge of the outer container.

The basis of the invention therefore is the problem of providing a container of the above mentioned type which at the opening side exposes an even single layer of lining material and in which the lining is secured to the outer container especially adjacent the upper edge of the container, and in which the lining and the outer container are formed and connected so that the opening side of the container is somewhat lowered from the upper edge of the outer container.

According to the invention the lining is somewhat submerged in itself at the opening side of the container so as to provide around the upwardly directed opening side a projecting edge of a double layer of lining material, and the outer container is formed with top flaps extending from the upper edge thereof, which flaps are folded in and attached to the projecting edge of lining material so that the lining is thereby secured in the outer container with the opening side thereof somewhat lowered from the upper edge of the container.

According to a method and an apparatus for manufacturing of containers according to the invention the outer container and the lining are manufactured separately whereby the lining is manufactured by folding over a strip of lining material and welding the free edges thereof, expanding the lining at the same time as the lining is pushed into the outer container and pressing the lining somewhat into itself at the opening end by means of a piston so as to provide a projecting edge of a double layer of lining material extending around the opening side of the lining, whereupon the lining is secured in the outer container in that top flaps of the outer container are folded down and are attached to the projecting edge of the lining. Thereafter, the container is filled and sealed in a way known per se from the end of the container which is to become the bottom thereof.

According to a modified embodiment of the container the lining is manufactured in a conventional way, whereby a joint rib extends over the opening side of the container, and the invention includes any type of lining having an even opening side and being adapted for being sealed at the opposite end thereof.

Further characteristics of the invention will be evident from the following detailed specification in which reference will be made to the accompanying drawings.

In the drawings

Figure 6:
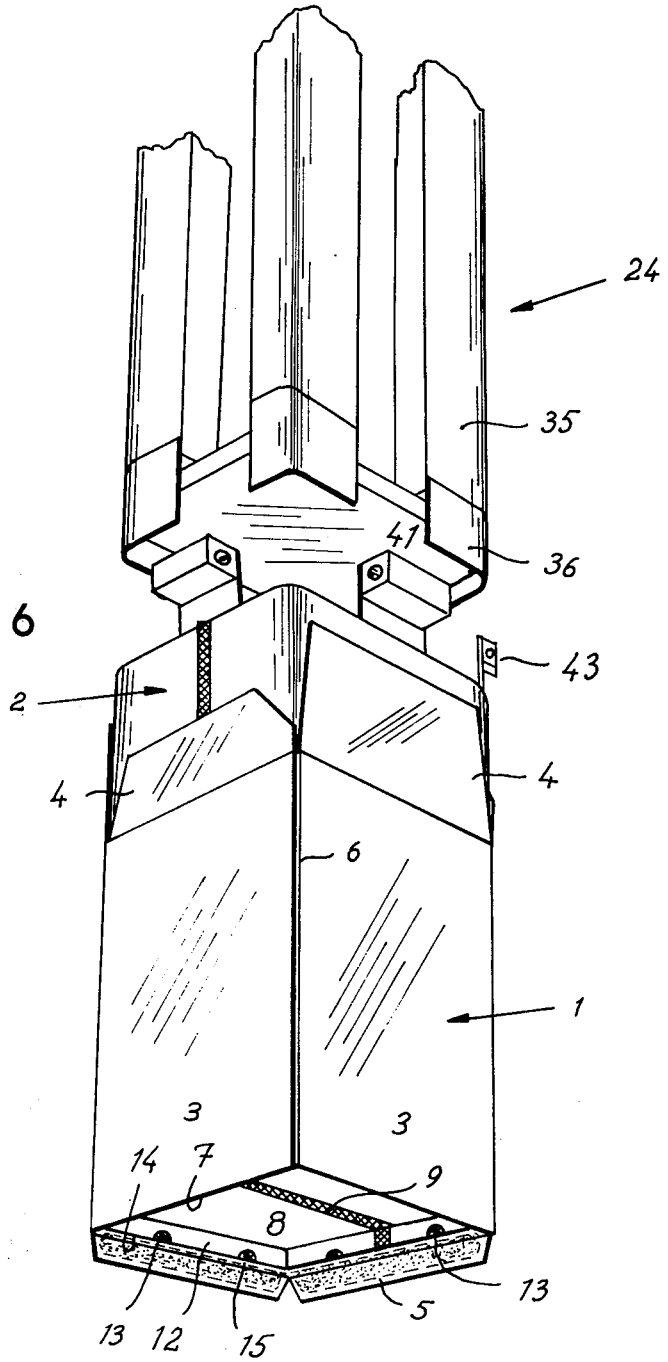

FIG. 6 diagrammatically illustrates a step in the manufacture of the container according to the invention.

Figure 7:
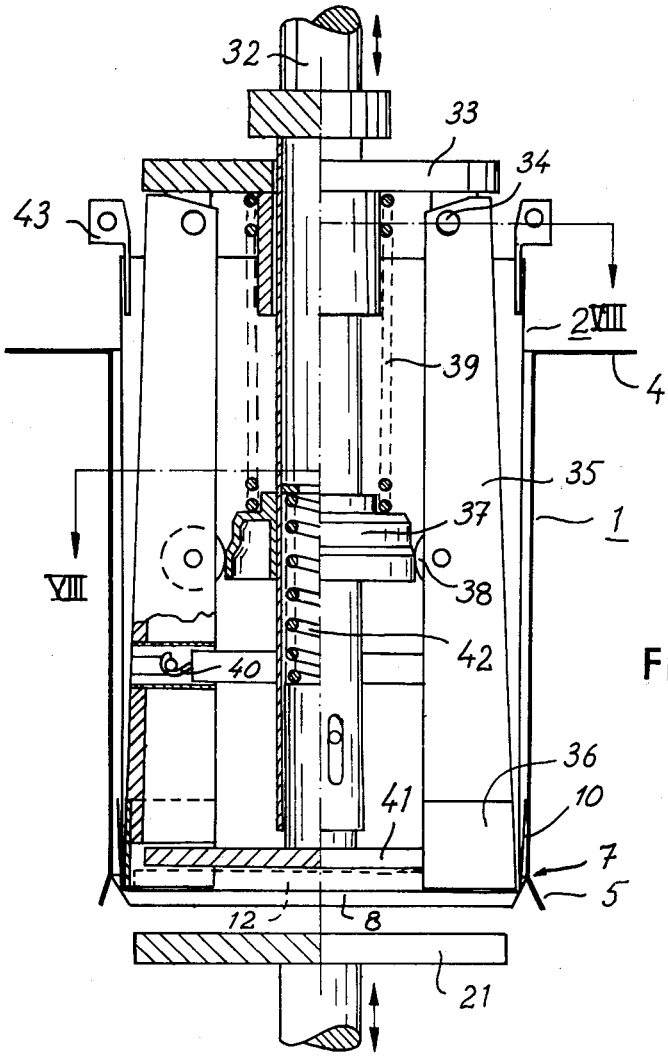
Figure 8:
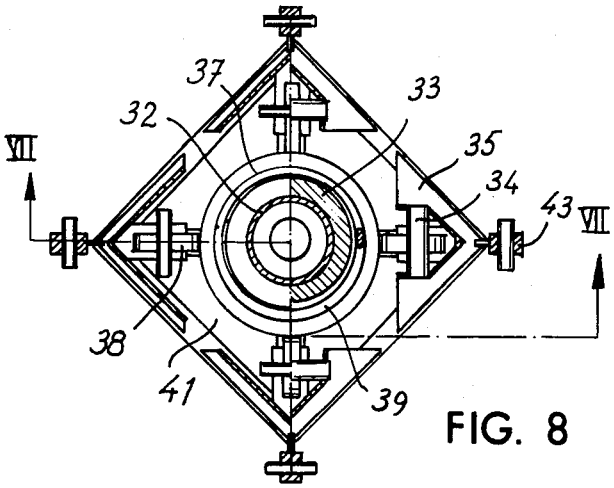

FIG. 7 shows, partly in an axial cross section, an apparatus for executing the method seen along line VII—VII of FIG. 8 and FIG. 8 is a cross section along line VIII—VIII of FIG. 7.

FIG. 9 diagrammatically illustrates in five different views a–e the method for manufacture of a container according to the invention.

It is to be understood that the following specification and the embodiments shown in the drawings only illustrate examples and that different modifications may be presented within the scope of the appended claims.

Figure 1:
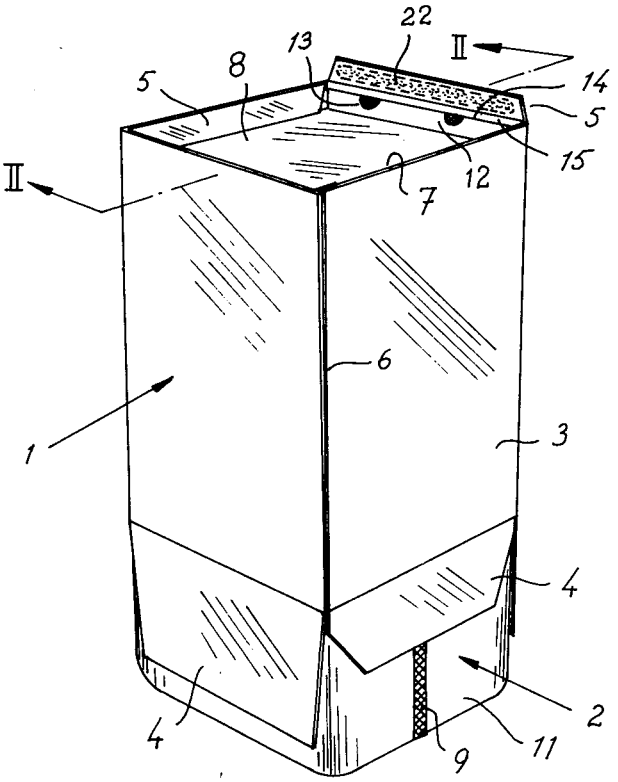
FIG. 1 is a perspective view of a partly prepared container before being filled and sealed.
Figure 2:
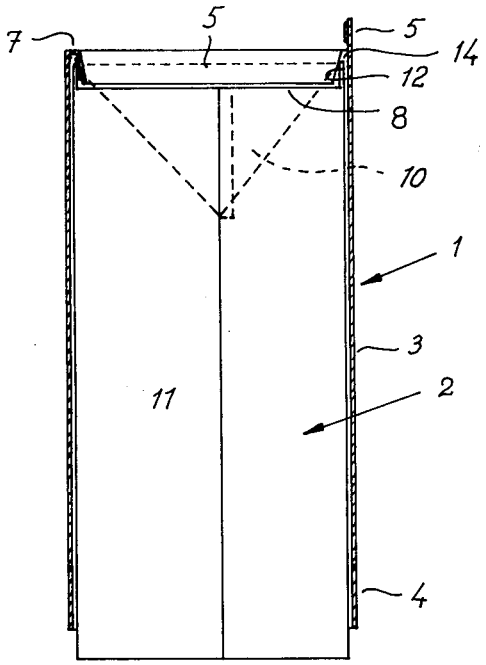
FIG. 2 is a cross section along line II—II of the container according to FIG. 1.
Figure 3:
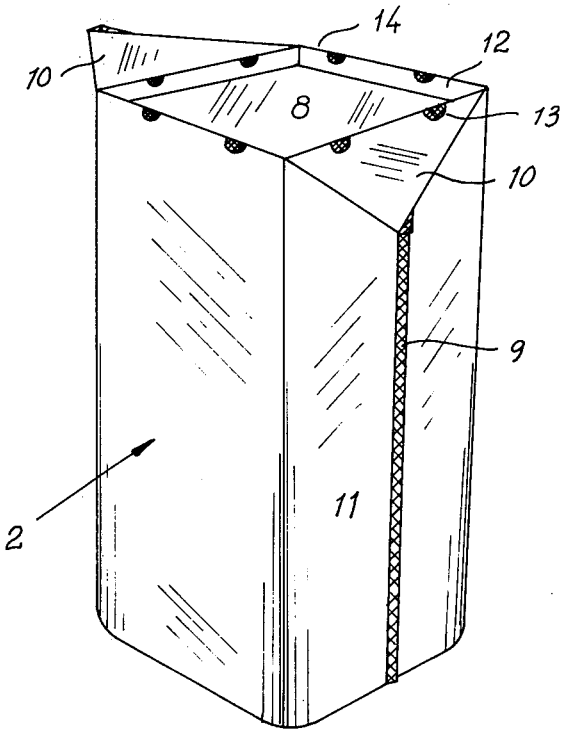
FIG. 3 is a perspective view showing the appearance of the lining separately before said lining is secured in the outer container.

The container shown in FIGS. 1–3 generally comprises an outer container 1 of cardboard or similar stiff material and a lining 2 of an evenly foldable and preferably liquid and gas sealing material like plastic, a plastic-aluminum laminate or the like, which lining is provided in the outer container 1.

The outer container 1 may have any cross section form such as square, rectangular, circular, elliptic etc. The outer container is made from a plane punched blank comprising sides 3, bottom close flaps 4 and top close flaps 5. Before the lining 2 is introduced into the outer container said outer container is folded together into tubular form, whereby the joint 6 is preferably placed adjacent a corner. The bottom close flaps 4 are formed large enough to provide a closing of the bottom of the outer container by overlapping of at least two opposite flaps. The top flaps 5 are relatively narrow and the width thereof is defined by the intended depth of the opening side 8 of the lining below the upper edge 7 of the container. When the upper side of the container is ready the top flaps 5 are folded in and enclose between themselves and the outer container sides 3 at least some part of the lining 2.

The lining is made of a plane sheet of lining material which is folded double whereupon the two side edges are welded together to provide two side joints 9, whereby the lining appears to be a flat sack. The lining is opened to intended form preferably by means of a mandrel, the form of which corresponds to the form of the outer container and which is slightly smaller than the inner surface of the outer container. When opening the lining to the four edge form which is shown in FIGS. 1–3 two opposite lining ears 10 are formed at two opposite upper edges, which ears are folded down along the sides 11 of the lining. After the lining is opened to its intended form it is pushed into the outer container and it is formed in a way which will be described in greater detail below so that the opening side 8 of the lining is pushed back some distance into the lining so as to provide a lining rib 12 extending around the opening side 8, which rib except for the lining layers comprises two ears of lining material. The two layers may be secured in relation to each other by point welds or rib welds 13 which connect the two layers of lining material with each other. The upper edge 14 of the lining rib 12 may be provided adjacent the upper edge 7 of the outer container, but preferably the lining edge 14 is located at a slightly lower level than the edge 7 of the outer container in order to make the double folded outer container edge as smooth and thin as possible and to facilitate the attachment of the top flaps 5 by connection of cardboard to cardboard at the space 15 between the upper edges 7 and 14 of the outer container and the lining, respectively.

The container lining 2 is filled and closed at the bottom in a way known per se, and the bottom close flaps 4 of the outer container provides the composite bottom of the container.

The method of manufacturing the container according to the invention includes the following series of manufacturing steps:

1. An outer container blank is manufactured by being punched, creased and folded together to tubular form by a plane blank of cardboard or similar stiff material, and concurrently therewith a lining blank is manufactured by folding a plane lining material blank 2 together and folding the side edges of said double folded blank together at 9 to provide a flat lining bag.

2. The lining bag 2 is opened in any suitable way as by means of suction devices 16 to enable the introduction of a formation tool into the remaining open end of the lining.

3. For forming the lining a mandrel can be used, for instance in expandable mandrel 17 which in its non-expanded state can easily be introduced into the lining bag and which by being expanded gives the lining bag its intended form, whereby the projecting lining ears 10 are formed.

4. During the expansion of the mandrel 17 the lining is successively introduced into the opened outer container tube 1, whereby the lining ears 10 are fold back towards the sides 11 of the lining. The lining is introduced into the outer container with the upper side of the lining adjacent the upper edge 7 of the outer container, but the upper side of the lining may optionally be located above or underneath the said upper edge 7.

5. When the lining is located in the intended position in the outer container blank the mandrel 17 is contracted and is pulled out of the lining.

Figure 4:
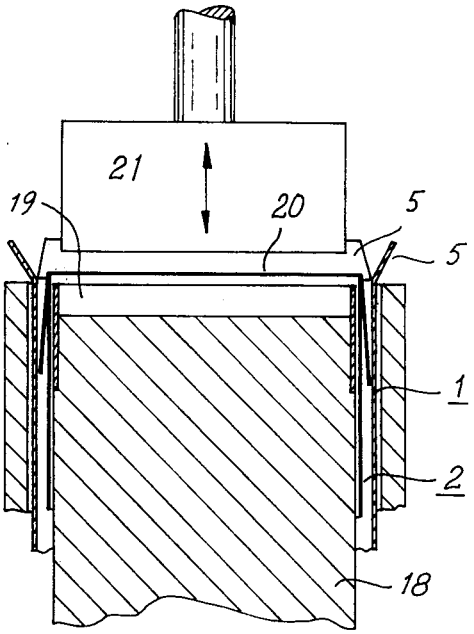
FIG. 4 shows diagrammatically and in a vertical cross section the method for forming the lining rib extending around the opening side of the lining.
Figure 5A:
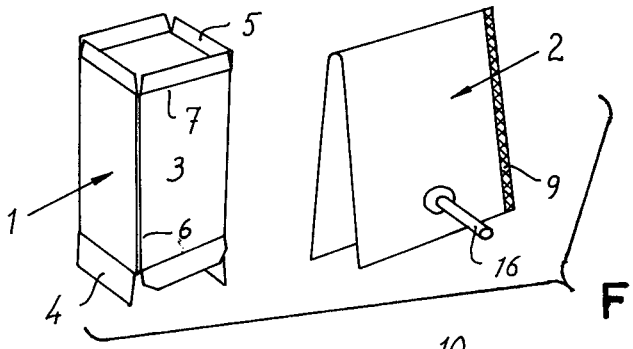
FIG. 5 is a sequence of drawings which diagrammatically illustrate the method of manufacturing the container according to the invention.
Figure 5B:
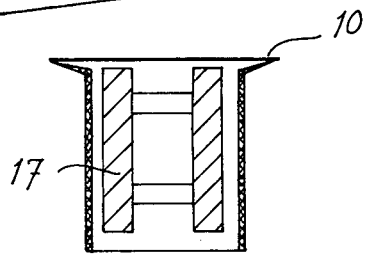
Figure 5C:
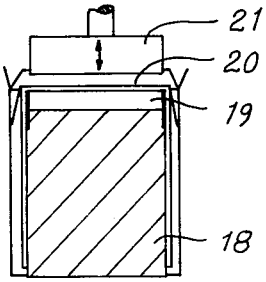
Figure 5D:
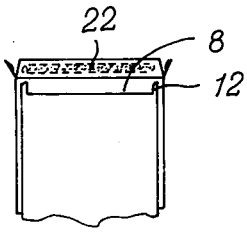
Figure 5E:
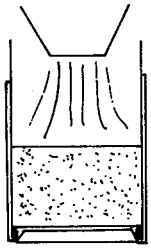

6. Now a fixed mandrel 18 is introduced into the lining which mandrel is best shown in FIG. 4. The said fixed mandrel 18 has at the upper end thereof a projecting narrow rib 19 over which the lining rib 12 is intended to be formed. Depending on the intended height of the lining rib 12 the mandrel 18 is introduced to a level at or preferably some distance under the upper side 20 of the lining. For co-operation with the edge rib 19 of the mandrel 18 there is a piston 21, the outer dimensions of which substantially correspond to or are slightly less than the inner surface of the rib 19.

7. The outer container blank 1 with the lining 2 and the mandrel 18, 19 is provided in a cartridge so that the said three parts are kept in an intended position in relation to each other.

8. If desired, the lining may be pre-secured in the outer container by means of glue points so that the lining is not moved in the outer container during the subsequent operation.

9. For forming the lining rib 12 the piston 21 is pressed down into the area inside the rib 19 of the mandrel 18, whereby some part of the upper side 20 of the lining is pressed down at the same time, which part is the intended opening side 8 of the lining. As mentioned previously the height of the lining rib 12 and the distance thereof from the upper edge 7 of the outer container may be adapted to circumstances, and if a high rib is wanted the edge rib 19 of the mandrel 18 is made correspondingly high and the mandrel is placed at a corresponding long distance below the upper side 20 of the lining blank. If a narrow lining rib is desired, the rib 19 of the mandrel 18 need not be higher than the intended lining rib. If for some reason it is desired to locate the upper edge 14 of the lining rib on line with the upper edge 7 of the outer container the lining blank is introduced in the above described step 4 so that the upper side 20 thereof is located above the upper edge 7 of the outer container a distance corresponding to the movement downwards and the edge formation which is provided by pressing the piston 21 down.

10. Except for the lining ears 10 the lining rib 12 comprises two layers of lining material, and to prevent a mutual movement between the said two layers of lining material during the subsequent treatment the layers are connected by being welded together at 13 by points, rib portions or a weld rib extending around the entire lining rib. At least two opposite edges of the lining rib 12 ought to be connected as mentioned and the said two edges preferably are the edges which have no lining ears.

11. The projecting top flaps 5 of the outer container are now supplied with glue 22 such as hot-melt or any other type of glue. The application of glue can be made in that the top flaps are folded fully outwards to the outsides of the outer container and the outer container blank is dipped down into a glue bath whereby glue sticks both to the top flaps 5 and to the space 15 between the upper edge 14 of the lining and the upper edge 7 of the outer container and it may also to some degree stick to the inner surface of the lining rib 12.

12. Now the top flaps 5 are folded in to enclose the lining rib 12 between the said top flaps 5 and the sides 3 of the outer container. It is to be understood that the height of the top flap substantially should correspond to the distance between the opening side 8 of the lining and the upper edge 7 of the outer container so that the top flaps 5 are positioned in contact or close to the opening side 8 of the lining.

13. After the upper side of the container is completed as described above the container is turned upside down and is filled and closed from the bottom which is still open. The filling, the closing and the sealing is made in a way known per se. The filling step may also include compressing of the goods to be packed, evacuation of the air content etc.

Since the opening side 8 of the lining is located some distance below the upper edge 7 of the outer container the top flaps 5 act as a non-spill edge for packed goods which may come up from the container at the same time as they safely attach the lining to the outer container adjacent the upper edge thereof. The container is easily opened in that the opening side 8 of the lining is cut open or in that the said side of the lining is formed with a strip off indication or similar means. With the above container there is no risk that the packed goods penetrates into the space between the lining and the outer container thereby tending to release the lining from the outer container. Also the risk that the lining is released from the outer container as a result of jarring, vibration or careless handling is substantially completely eliminated even if there should be any space between the lining and the bottom of the outer container after the lining is filled and closed.

In a modified method of manufacturing a container according to the invention illustrated in connection with FIG. 9 of the drawings an outer container sleeve 1 and a lining bag 2 are manufactured independently of each other, whereupon a fixed mandrel 18 which to form and size substantially corresponds to the intended form of lining is introduced in the lining and under the action of the said mandrel the lining is introduced into the outer container sleeve so that the even end surface of the lining is located a short distance below the upper edge 7 of the outer container. The lining ears 10 are folded down along the sides of the lining when the lining bag is introduced into the outer container sleeve. An exhauster 23 holds the lining and the fixed mandrel 18 is pulled out and is replaced by an expandable mandrel 24 having a spring actuated bottom plate 25, which is introduced into the lining bag. The mandrel 24 is expanded in that the corners thereof are moved outwards until the lining reaches the desired form, the exhauster 23 is removed, and co-operating with the spring actuated bottom plate 25 at the inside of the lining a piston 21 acting from outside forces the lining from the outside down into itself. During said operation the lining keeps its position in the outer container sleeve. The expandable mandrel 24 is retracted some distance in the lining at the same time as it regains its contracted position. This is illustrated in FIG. 9*b*.

FIG. 9*c* is illustrates how the two layers of lining material are welded together at the lining rib 12 which is made by means of weld jaws 26 which from inside are moved out to the lining rib thereby welding the two layers of lining material together at points or at rib portions or completely co-operating with counter jaws 27 acting from outside.

FIG. 9*d* illustrates how the top flaps 5 of the outer container are folded out and the outer container with the lining is moved down through a glue mold 28 and down into a glue bath 29 while the top flaps 5 by the glue mold 28 are folded up along the sides of the outer container. When moving the outer container down into the glue bath 29 a string of glue 22 is obtained at and adjacent the upper edge of the outer container as illustrated in FIG. 6.

After glue is applied the outer container with the lining is pulled up on the glue mold 28 and the top flaps 5 are folded in and are compressed, thereby enclosing the lining rib 12 which is made by means of an inner mandrel 30 and an outer counter tool 31.

For pressing down the lining top to provide the lining rib 12 an apparatus is used which includes an expandable mandrel of the type which is illustrated in FIGS. 7 and 8. The expandable mandrel comprises a supporting shaft 32 which is movable in the vertical direction and on which a mandrel arm holder 33 is axially movable a limited distance. The mandrel arm holder 33 rotatably supports four mandrel arms 35 about pins 34, each mandrel arm providing a right-angled corner. The mandrel arms 35 are rotatably radially outwards from the center of the shaft 32, and at the lower end they are formed with a thin corner rib 36 over which the lining rib is to be formed. On the shaft 32 a cam means 37 is fixedly mounted, and for co-operation with the said cam each mandrel arm is formed with a guide roller 38. Between the cam means 37 and the mandrel arm 33 a compression spring 39 is mounted. The cam means 37 is widened in the downward direction so that the mandrel arms 35 are expanded when the mandrel arm holder 33 is moved downwards in relation to the supporting shaft 32. The compression spring 39 tends to keep the mandrel arms in their raised and non-expanded position. Contraction springs 40 contribute to a retraction of the mandrel arms to the said non-expanded position. A pressure plate 41 is mounted axially movably at the bottom of the supporting shaft 32 and the said pressure plate 41 is pressed downwards by a spring 42. For the sake of clearness FIG. 7 shows the pressure plate 41 raised some distance from the bottom (top) of the lining but it is to be understood that the pressure plate 41 contacts the bottom of the lining bag when the mandrel arms 35 are fully moved down in the lining bag. In order to keep the lining bag in an open position a holder arm 43 is mounted at each corner or each side of the lining bag. The said holder arms 43 can be stationarily mounted and spring biassed so that they are rotated down to their positions shown in FIG. 7 when the expandable mandrel is introduced into the bag.

As mentioned previously there is a piston 21 which co-operates with the apparatus for forming the lining, which piston is axially movable and which against the action of the spring loaded pressure plate 41 can press back the even opening side of the lining to give a lining rib 12 extending around the side of the lining which is intended to be opened.

The apparatus operates as follows: When moving the lining forming means down into the lining bag 2 the mandrel arms 35 are in their upper non-expanded position, but when the apparatus has been moved down to intended position in the lining bag the mandrel arm holder 33 is moved downwards in relation to the supporting shaft 32 whereby the mandrel arms 35 by co-operation of the cam means 37 and the guide rollers 38 are moved outwards while the lining is pressed outwards at its corners. The spring loaded press plate 41 thereby contacts the bottom of the lining. Thereafter the piston 21 is moved upwards so that the side 8 of the lining to be opened is pressed back into the lining thereby providing a lining rib 12 extending around the lining. With co-operation maintained between the piston 21 and the spring loaded press plate 41 the mandrel arms 35 are pulled up some distance so that the corner ribs 36 thereof are pulled out of the two layer lining rib thereby provided and so that the mandrel arms 35 regain their non-expanded position, whereupon the expandable mandrel including the spring loaded press plate 41 is pulled out of the lining bag. Thereafter the two layers of the lining material at the lining rib 12 are welded together as mentioned above and the container is filled, sealed and closed likewise as mentioned above.

I claim:

1. A container comprising an outer container of a stiff material and a lining of an easily formable material having a shape essentially adapted to the shape of the outer container, said lining being closed at one end, and that closed end being exposed at one end of the outer container and being essentially even and openable at that end, said lining being constructed to be filled with product at the end of the container opposite to said one end, the lining at said one end thereof being pressed down into itself in the central portion thereof to provide a projecting double layer rib extending all around its periphery at said one end of the container, and said outer container including flaps at said one end of the container which are folded over against the inwardly facing surface of said rib to secure said rib and hence said lining to the outer container with said central portion comprising an even, openable end of the container spaced below the higher parts of the outer container at said one end of the container.

2. A container according to claim 1, wherein the top edge of the rib at said one end is spaced slightly below the top edge of the outer container at said one end.

3. A container according to claim 1, wherein the two layers of the double layer rib are welded together.

4. A container according to claim 3, wherein said two layers of the rib are welded together at spaced apart points around the rib.

5. A container according to claim 3, wherein the two layers of the rib are welded together continuously around the rib.

6. A container according to claim 1, wherein both the inwardly facing and outwardly facing surfaces of the rib are secured by adhesive to the inside of the flaps and to the inner wall of the container, respectively.

7. A container according to claim 1, wherein the said rib is secured by adhesive only to the said flaps of the outer container.

8. A container according to claim 1, wherein the lining is secured to the inner surface of the outer container by adhesive points located at different heights along the container.

9. A container according to claim 1, wherein the said flaps of the outer container are of substantially the same width as the distance between the even openable layer and the upper edge of the outer container.

10. A container according to claim 1, said lining being a bag formed from a flat sheet of material having been folded over and sealed along both lateral edges and left open at the free end and forming at the folded end thereof said closed end formed with ear flaps at the sides thereof upon placement of the lining into the outer container, said ear flaps being folded down from said closed end between the lining and the inside walls of the outer container.

* * * * *